US012723576B2

(12) United States Patent
Nishida et al.

(10) Patent No.: US 12,723,576 B2
(45) Date of Patent: Sep. 1, 2026

(54) ROTARY SWASH PLATE HYDRAULIC PUMP

(71) Applicant: KAWASAKI JUKOGYO KABUSHIKI KAISHA, Kobe (JP)

(72) Inventors: Shinji Nishida, Kobe (JP); Isamu Yoshimura, Kobe (JP); Yusei Miyamoto, Kobe (JP); Satoru Takao, Kobe (JP)

(73) Assignee: KAWASAKI JUKOGYO KABUSHIKI KAISHA, Kobe (JP)

( * ) Notice: Subject to any disclaimer, the term of this patent is extended or adjusted under 35 U.S.C. 154(b) by 50 days.

(21) Appl. No.: 18/852,389

(22) PCT Filed: Mar. 22, 2023

(86) PCT No.: PCT/JP2023/011234
§ 371 (c)(1),
(2) Date: May 7, 2025

(87) PCT Pub. No.: WO2023/189944
PCT Pub. Date: Oct. 5, 2023

(65) Prior Publication Data

US 2026/0015997 A1 Jan. 15, 2026

(30) Foreign Application Priority Data

Mar. 31, 2022 (JP) ..... 2022-061103

(51) Int. Cl.
*F04B 1/146* (2020.01)
*F04B 1/143* (2020.01)
(Continued)

(52) U.S. Cl.
CPC ..... *F04B 1/146* (2013.01); *F04B 1/143* (2013.01); *F04B 1/145* (2013.01); *F04B 49/12* (2013.01); *F04B 53/10* (2013.01)

(58) Field of Classification Search
CPC ..... F04B 1/146; F04B 1/143; F04B 1/145; F04B 49/12; F04B 53/10
See application file for complete search history.

(56) References Cited

U.S. PATENT DOCUMENTS 3,002,462 A 10/1961 Raymond
3,679,328 A * 7/1972 Cattanach ..... F04B 1/148 417/270

(Continued)

FOREIGN PATENT DOCUMENTS

JP S43006655 * 3/1968
JP S43006655 B1 3/1968

(Continued)

OTHER PUBLICATIONS

English language machine translation of JPS43006655 generated Jan. 7, 2026 (Year: 2026).*

(Continued)

*Primary Examiner* — Bryan M Lettman
(74) *Attorney, Agent, or Firm* — Alleman Hall LLP

(57) ABSTRACT

This rotary swash plate hydraulic pump includes: a casing including an inlet passage; a cylinder block disposed in the casing so as to prevent relative rotation of the cylinder block and including a plurality of cylinder bores connected to the inlet passage; a plurality of pistons each of which is inserted into a corresponding one of the plurality of cylinder bores; and a rotary swash plate that is housed in the casing so as to be rotatable about an axis and reciprocates each of the plurality of pistons. The inlet passage includes a plurality of inlet ports through which a working fluid is drawn.

7 Claims, 7 Drawing Sheets

(51) Int. Cl.

| | |
|---|---|
| ***F04B 1/145*** | (2020.01) |
| ***F04B 49/12*** | (2006.01) |
| ***F04B 53/10*** | (2006.01) |

(56) References Cited

U.S. PATENT DOCUMENTS

| | | | | |
|---|---|---|---|---|
| 9,752,563 | B2 * | 9/2017 | Yamamoto | F04B 1/295 |
| 2015/0159645 | A1 * | 6/2015 | Nakaima | F04B 1/295<br>417/213 |
| 2015/0267692 | A1 * | 9/2015 | Yamamoto | F04B 27/1804<br>417/218 |

FOREIGN PATENT DOCUMENTS

| | | | |
|---|---|---|---|
| JP | S45032181 | * | 12/1970 |
| JP | S45032181 | Y1 | 12/1970 |
| JP | H0343687 | A | 2/1991 |
| JP | 2015113766 | A | 6/2015 |
| JP | 2016205266 | A | 12/2016 |

OTHER PUBLICATIONS

ISA Japan Patent Office, International Search Report Issued in Application No. PCT/JP2023/011234, May 23, 2023, WIPO, 5 pages.

ISA Japan Patent Office, Written Opinion Issued in Application No. PCT/JP2023/011234, May 23, 2023, WIPO, 8 pages.

* cited by examiner

ROTARY SWASH PLATE HYDRAULIC PUMP

TECHNICAL FIELD

The present invention relates to a rotary swash plate hydraulic pump in which a rotary swash plate is rotated to reciprocate a piston.

BACKGROUND ART

For example, a rotary swash plate piston pump such as that disclosed in Patent Literature (PTL) 1 is known as a piston pump. In the piston pump disclosed in PTL 1, a piston reciprocates when a rotary swash plate rotates. As a result, pressure oil is discharged from the piston pump.

CITATION LIST

Patent Literature

PTL 1: Japanese Laid-Open Patent Application Publication No. 2016-205266

SUMMARY OF INVENTION

Technical Problem

In the piston pump disclosed in PTL 1, a plurality of cylinder bores and a plurality of inlet chambers are formed in a cylinder block. Each of the cylinder bores is connected to a discharge port via a corresponding one of the inlet chambers. The path of a working fluid that is brought from the discharge port to each of the inlet chambers depends on the inlet chamber. Therefore, pressure loss that occurs in the working fluid is different for each of the cylinder bores. As a result, the inlet pressure varies from one cylinder bore to another.

Thus, an object of the present invention is to provide a rotary swash plate hydraulic pump in which variations among cylinder bores regarding pressure loss that occurs in a working fluid can be reduced.

Solution to Problem

A rotary swash plate hydraulic pump according to the present invention includes: a casing including an inlet passage; a cylinder block disposed in the casing so as to prevent relative rotation of the cylinder block and including a plurality of cylinder bores connected to the inlet passage; a plurality of pistons each of which is inserted into a corresponding one of the plurality of cylinder bores; and a rotary swash plate that is housed in the casing so as to be rotatable about an axis and reciprocates each of the plurality of pistons. The inlet passage includes a plurality of inlet ports through which a working fluid is drawn.

According to the present invention, the inlet passage includes a plurality of inlet ports through which the working fluid is drawn. Therefore, regarding paths in which the working fluid flows from the inlet ports to the cylinder bores, the differences between the cylinder bores can be reduced. Thus, the variations among the cylinder bores regarding pressure loss that occurs in the working fluid can be reduced.

As a result, in the plurality of cylinder bores, inlet pressure for drawing in the working fluid can be secured.

Advantageous Effects of Invention

According to the present invention, it is possible to reduce variations among cylinder bores regarding pressure loss that occurs in a working fluid in a rotary swash plate hydraulic pump.

The above object, other objects, features, and advantages of the present invention will be made clear by the following detailed explanation of preferred embodiments with reference to the attached drawings.

DESCRIPTION OF EMBODIMENTS

Figure 1:
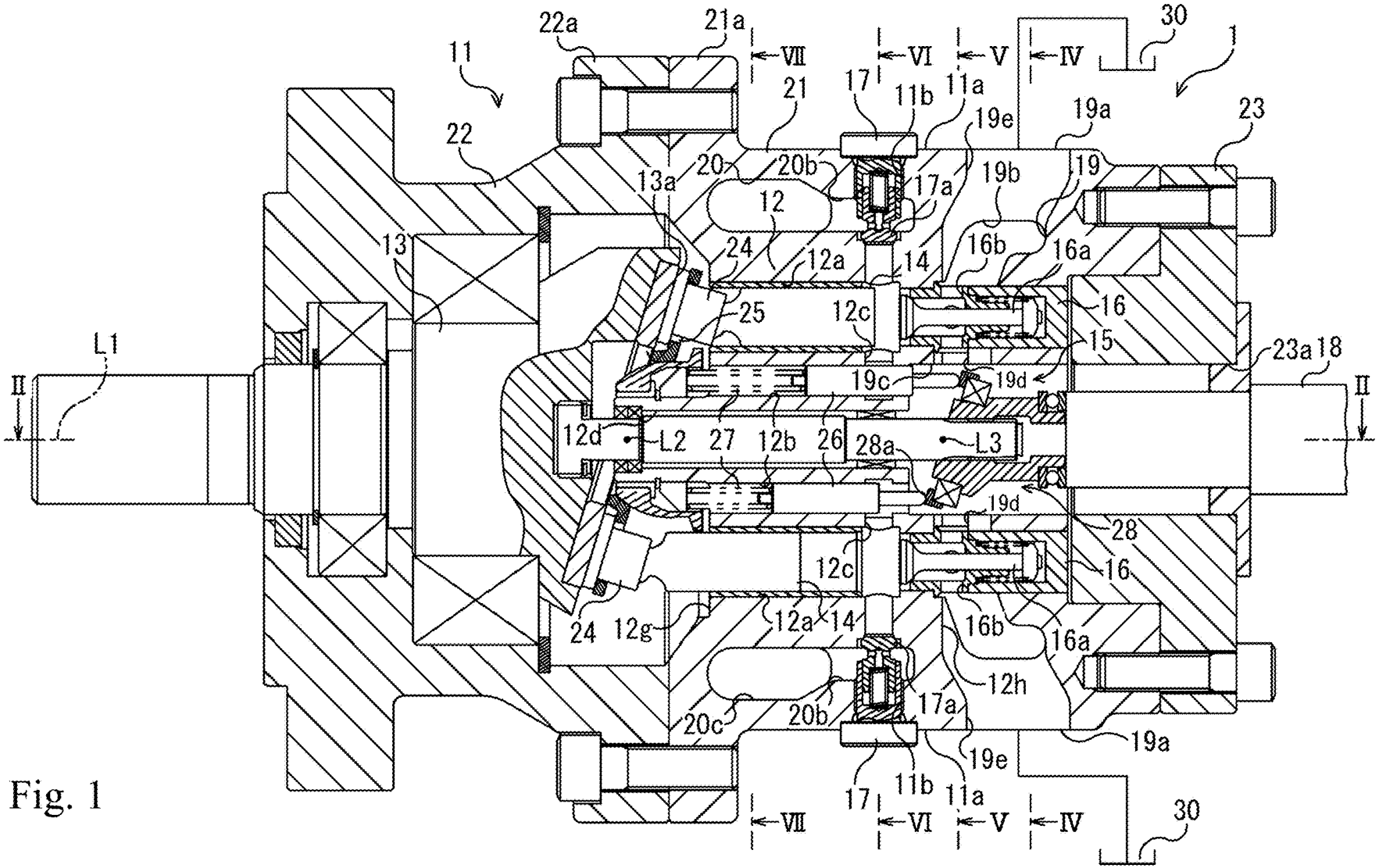
FIG. 1 is a cross-sectional view of a rotary swash plate hydraulic pump according to an embodiment of the present invention.

Hereinafter, a rotary swash plate hydraulic pump 1 according to an embodiment of the present invention will be described with reference to the aforementioned drawings. Note that the concept of directions mentioned in the following description is used for the sake of explanation; the orientations, etc., of elements according to the invention are not limited to these directions. The rotary swash plate hydraulic pump 1 described below is merely one embodiment of the present invention. Thus, the present invention is not limited to the embodiments and may be subject to addition, deletion, and alteration within the scope of the essence of the invention.

<Rotary Swash Plate Hydraulic Pump>

The rotary swash plate hydraulic pump 1 illustrated in FIG. 1 and FIG. 2 (hereinafter referred to as "the pump 1") is provided in various machines, for example, construction equipment such as an excavator and a crane, industrial equipment such as a forklift, farm equipment such as a tractor, and hydraulic equipment such as a press machine. In the present embodiment, the pump 1 is a hydraulic pump of the rotary swash plate type with a variable capacity. The pump 1 includes a casing 11, a cylinder block 12, a rotary swash plate 13, and a plurality of pistons 14. Furthermore, the pump 1 includes a variable capacity mechanism 15, a plurality of inlet check valve 16, and a plurality of discharge check valves 17. The pump 1 is driven by a drive source (for example, one or both of an engine and an electric motor). Thus, the pump 1 discharges a working fluid.

<Casing>

Figure 3:
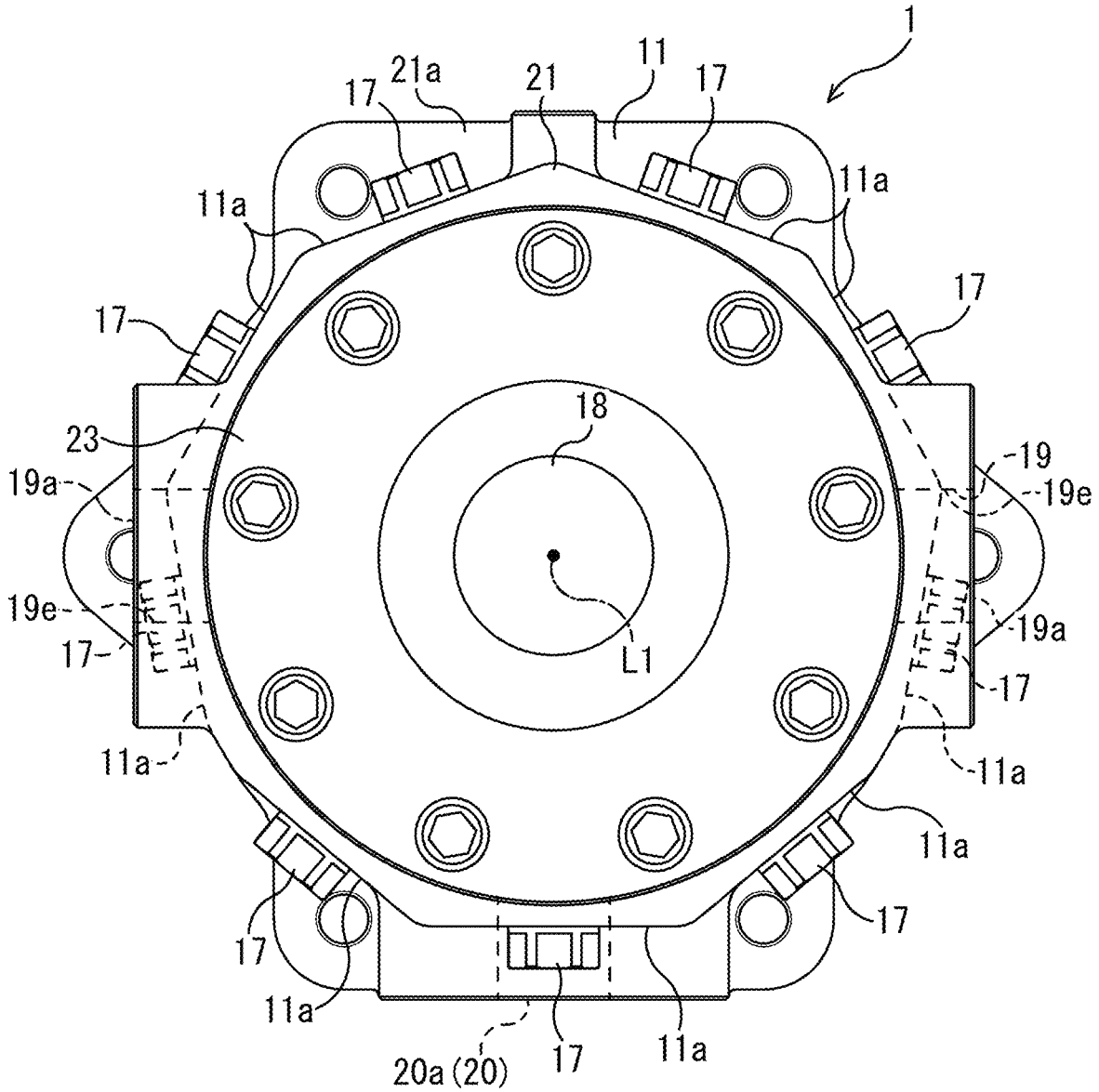
FIG. 3 is a right side view of the rotary swash plate hydraulic pump illustrated in FIG. 1 as viewed from the other side in the axial direction.

The casing 11 houses the cylinder block 12, the rotary swash plate 13, the pistons 14, and the variable capacity mechanism 15. The casing 11 includes an inlet passage 19 and a discharge passage 20. The casing 11, which is a cylindrical member, extends along a predetermined axis L1. More specifically, the casing 11 is in the shape of a prism having a plurality of flat surfaces 11*a* as side surfaces, as illustrated in FIG. 3. Therefore, the casing 11 is polygonal as viewed from the other side in the axial direction. In the present embodiment, the casing 11 is in the shape of a prism having the same number of flat surfaces 11*a* as cylinder bores 12*a*, which will be described later, specifically, nine flat surfaces 11*a*. In other words, the casing 11 is in the shape of a nonagon as viewed from the other side in the axial direction. Each of the flat surfaces 11*a* is formed to be level and rectangular. More specifically, the external shape of the casing 11 from the axially middle portion to the other axial end portion thereof is a nonagon. Meanwhile, the external shape of the casing 11 at a portion that is located on one side in the axial direction in which the axis L1 extends is a circle. The casing 11 is open at one end and the other end that are on one side and the other side in the axial direction in which the axis L1 extends.

Figure 4:
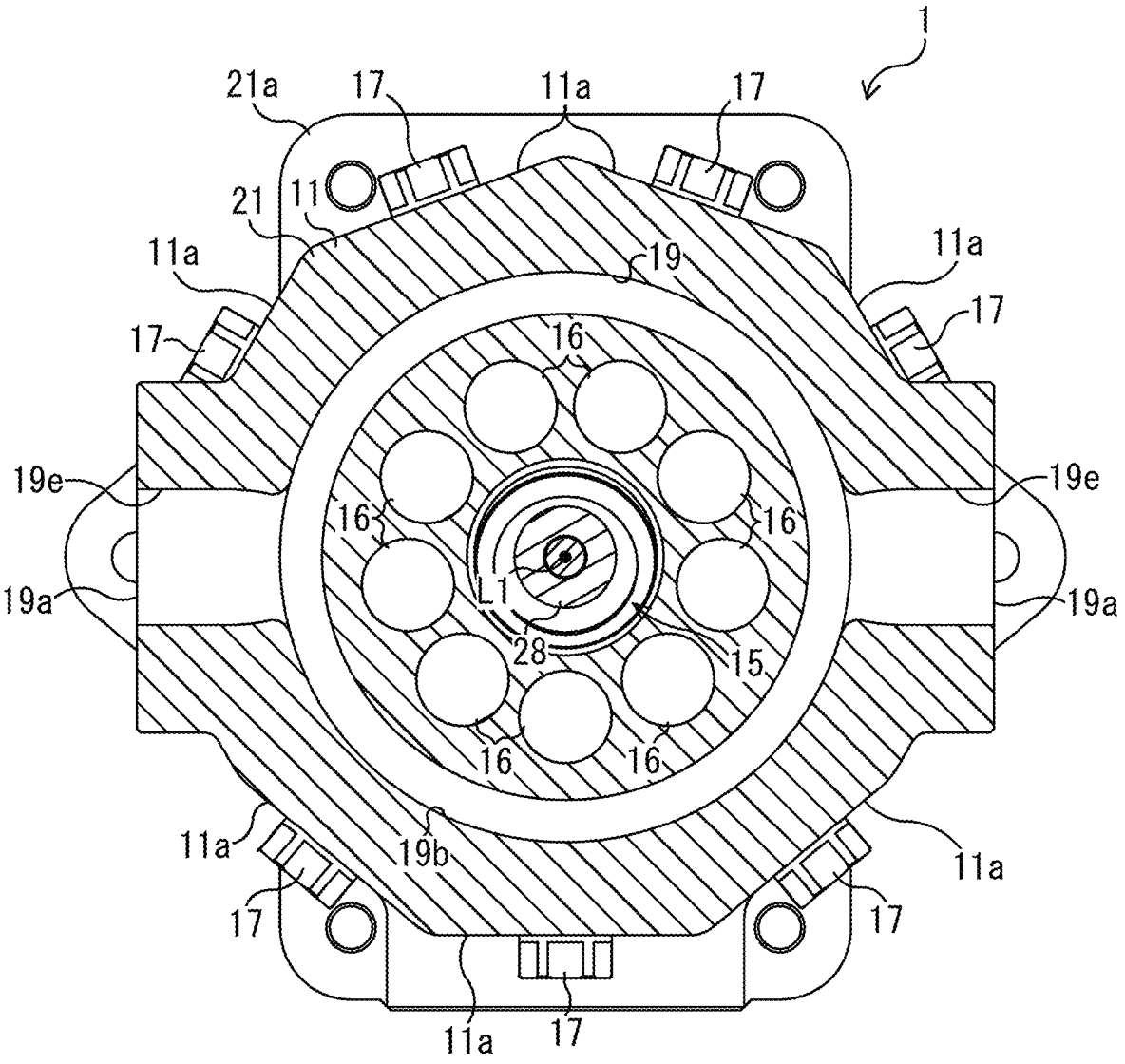
FIG. 4 is a cross-sectional view of the rotary swash plate hydraulic pump taken along the section line IV-IV indicated in FIG. 1.
Figure 5:
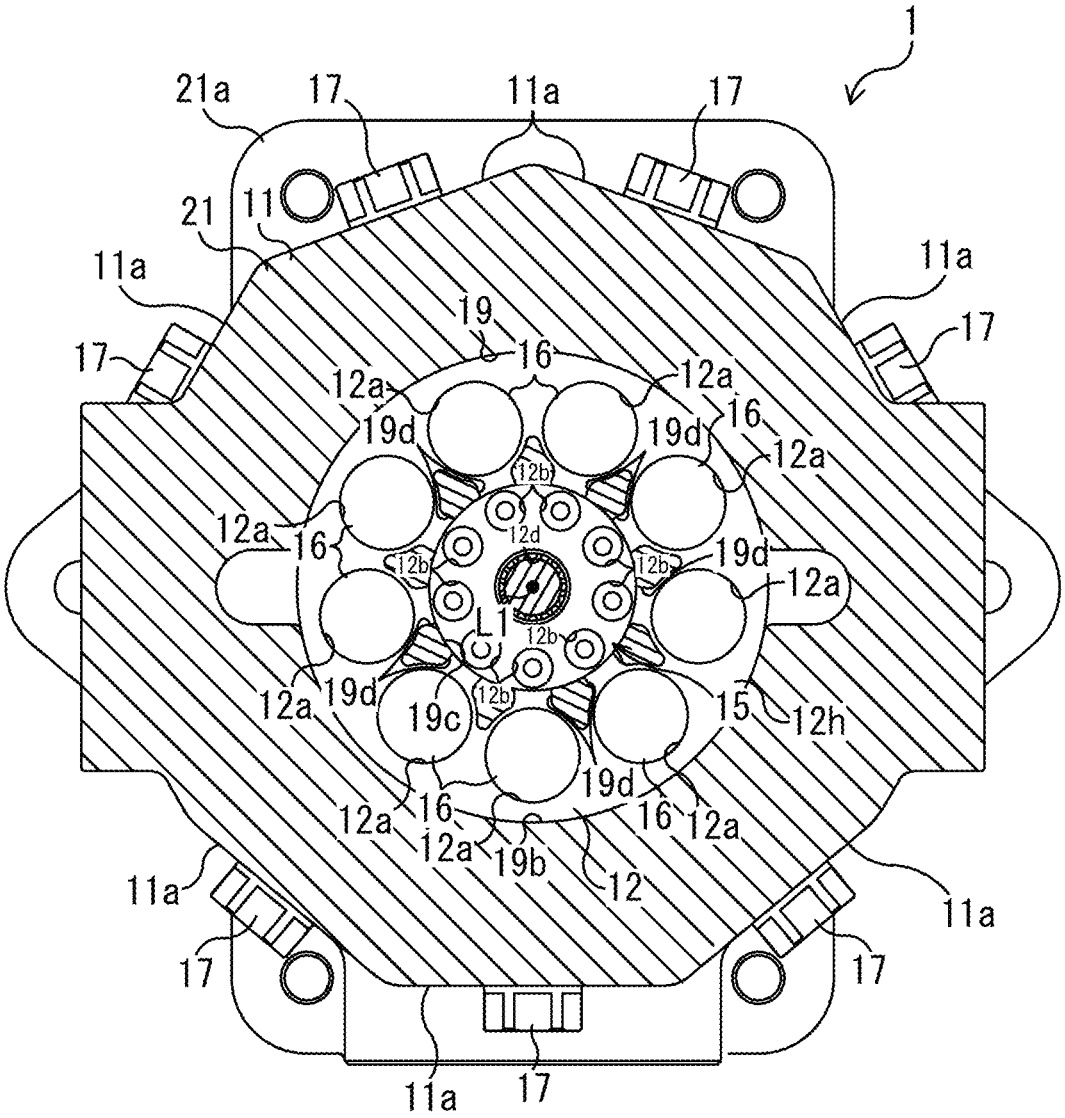
FIG. 5 is a cross-sectional view of the rotary swash plate hydraulic pump taken along the section line V-V indicated in FIG. 1.

The inlet passage 19 includes a plurality of inlet ports 19*a*. Furthermore, the inlet passage 19 includes an inlet-end ring-shaped portion 19*b*, a communication chamber 19*c*, and a plurality of communication portions 19*d*. The inlet passage 19 is formed at the other end portion of the casing 11. More specifically, the inlet passage 19 is formed on the other side of the cylinder block 12, which is housed in the casing 11, in the axial direction. The inlet passage 19 is connected to the plurality of cylinder bores 12*a* of the cylinder block 12, which will be described in detail later. The inlet passage 19 is formed in the shape of a ring as viewed in the axial direction, as illustrated in FIG. 4. The inlet passage 19 is positioned so as to overlap each of the cylinder bores 12*a* as viewed in the axial direction, as illustrated in FIG. 5. The inlet passage 19 is connected to a tank 30 and is also connected to the cylinder bores 12*a*. The working fluid is drawn from the tank 30 via the inlet passage 19.

Each of the inlet ports 19*a* is connected to the tank 30 (refer to FIG. 1). In the present embodiment, two inlet ports 19*a* are formed in the casing 11, as illustrated in FIG. 4. Note that the number of inlet ports 19*a* formed in the casing 11 is not limited to two and may be one or greater than or equal to three. The inlet ports 19*a* are formed in the outer peripheral surface of the casing 11, at the other axial end thereof. The inlet ports 19*a* are spaced apart at equal distances in the circumferential direction as viewed in the axial direction. In the present embodiment, the two inlet ports 19*a* are spaced part by 180 degrees.

The inlet-end ring-shaped portion 19*b* is formed in the shape of a ring (in the present embodiment, the shape of a circular ring) about the axis L1. The inlet-end ring-shaped portion 19*b* herein is formed in the shape of a circular ring centered on the axis L1. The outer and inner diameters of the inlet-end ring-shaped portion 19*b* are reduced radially inward toward an area on one side in the axial direction (refer also to FIG. 1). The other end surface 12*h* of the cylinder block 12 faces the inlet-end ring-shaped portion 19*b*. The inlet-end ring-shaped portion 19*b* overlaps the plurality of cylinder bores 12*a* as viewed in the axial direction, as illustrated in FIG. 5, and is connected to the plurality of cylinder bores 12*a*. The inlet-end ring-shaped portion 19*b* is connected to each of the inlet ports 19*a* at an outer peripheral portion. More specifically, the inlet ports 19*a* are connected at circumferentially spaced positions on the outer peripheral surface of the inlet-end ring-shaped portion 19*b*. In the present embodiment, the inlet ports 19*a* are connected to the outer peripheral surface of the inlet-end ring-shaped portion 19*b* at positions circumferentially spaced apart by 180 degrees.

More specifically, each of the inlet ports 19*a* is connected to an outer peripheral portion of the inlet-end ring-shaped portion 19*b* via a corresponding one of the passage portions 19*e*. The passage portions 19*e* are arranged circumferentially spaced apart on the outer peripheral surface of the inlet-end ring-shaped portion 19*b*. In the present embodiment, the passage portions 19*e* are formed at positions circumferentially spaced apart by 180 degrees on the outer peripheral surface of the inlet-end ring-shaped portion 19*b*.

The communication chamber 19*c* is positioned inward of the inlet-end ring-shaped portion 19*b*. The communication chamber 19*c* is also formed in the shape of a circular ring about the axis L1. The communication chamber 19*c* is in communication with the inlet-end ring-shaped portion 19*b* via the plurality of communication portions 19*d*.

Figure 6:
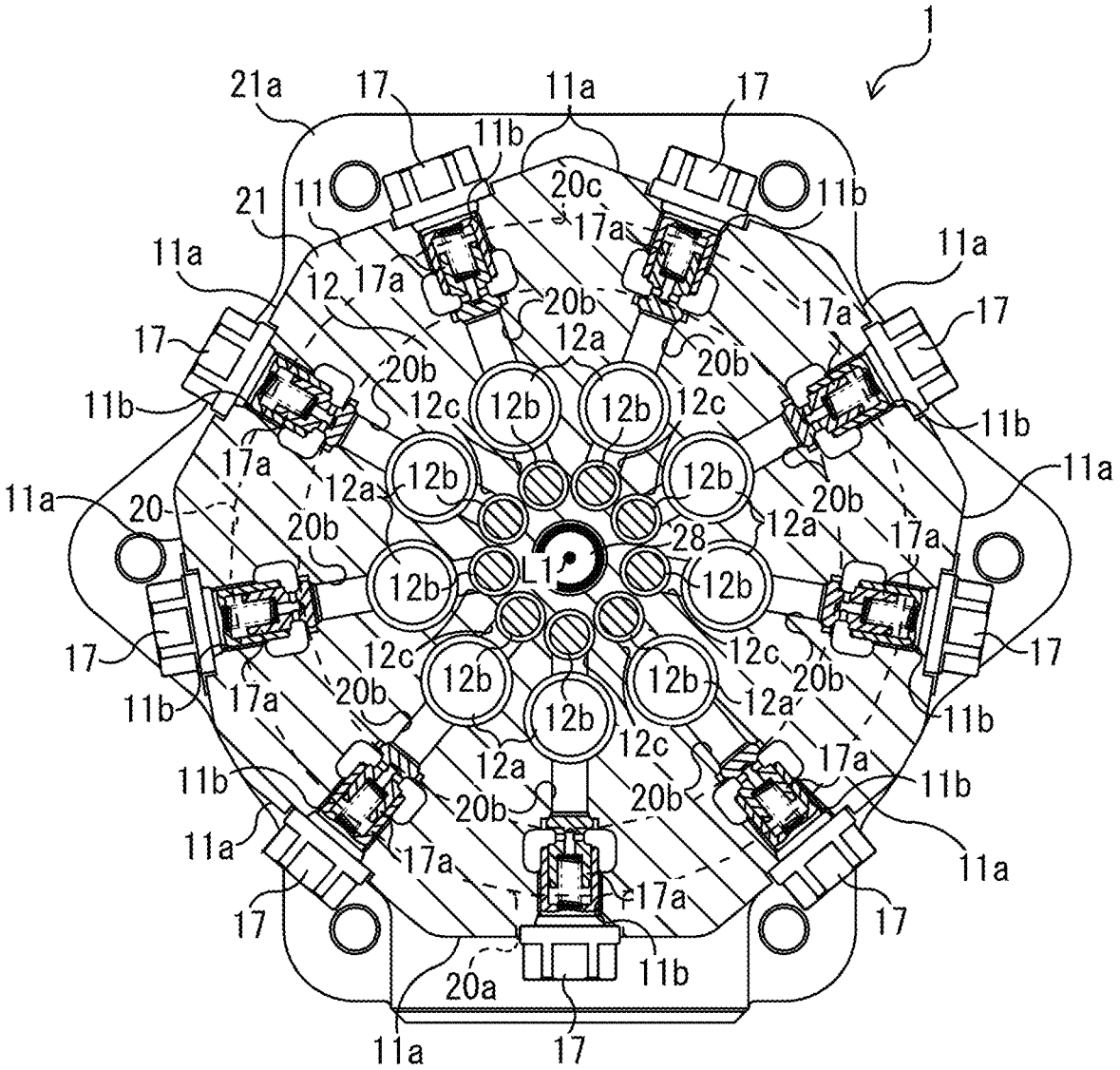
FIG. 6 is a cross-sectional view of the rotary swash plate hydraulic pump taken along the section line VI-VI indicated in FIG. 1.
Figure 7:
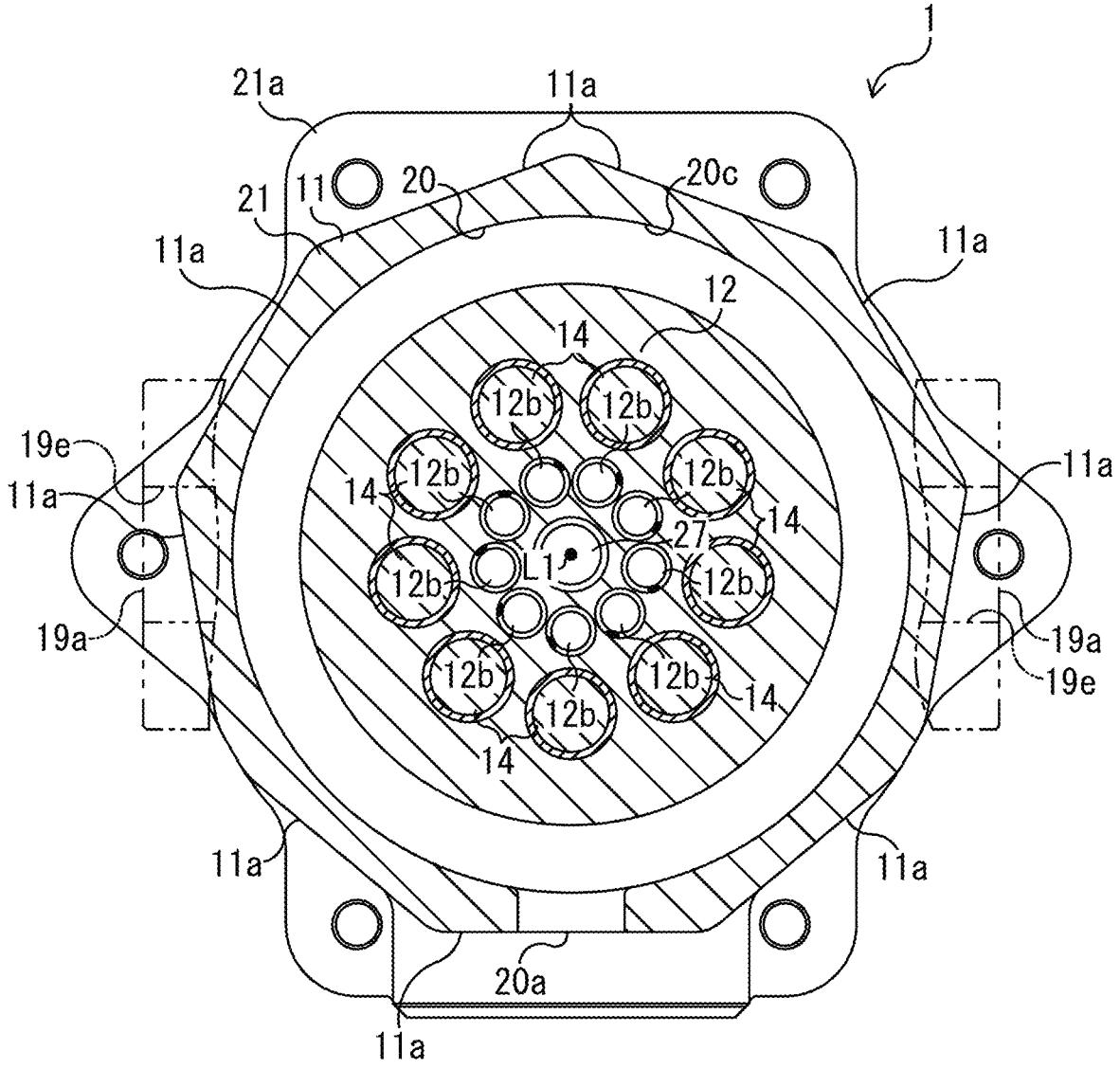
FIG. 7 is a cross-sectional view of the rotary swash plate hydraulic pump taken along the section line VII-VII indicated in FIG. 1.

As illustrated in FIG. 6 and FIG. 7, the discharge passage 20 includes a discharge port 20*a*. Furthermore, the discharge passage 20 includes a plurality of discharge-end branch portions 20*b* and a discharge-end ring-shaped portion 20*c*. The discharge passage 20 is formed in a middle portion of the casing 11. The discharge passage 20 is formed in the shape of a ring, as illustrated in FIG. 6 and FIG. 7. More specifically, the discharge passage 20 is formed in the shape of a circular ring in the casing 11 and exteriorly surrounds each of the cylinder bores 12*a*. The discharge passage 20 is connected to the cylinder bores 12*a*. The discharge passage 20 is connected to a hydraulic actuator (not illustrated in the drawings), for example. The pump 1 discharges, from the discharge passage 20, the working fluid brought from the cylinder bores 12*a*.

The discharge port 20*a* is formed in the outer peripheral surface of the casing 11. The discharge port 20*a* is disposed in a phase different in the circumferential direction from a phase in which the plurality of inlet ports 19*a* are located. More specifically, the discharge port 20*a* is placed at a position that is 90 degrees offset from each of the inlet ports 19*a* in the circumferential direction. Specifically, the positions of the discharge port 20*a* and the inlet ports 19*a* are different in the circumferential direction centered on the axis L1. The discharge port 20*a* is formed in the outer peripheral surface of the casing 11, at an axially middle portion thereof (refer to FIG. 1). The pump 1 discharges the working fluid from the discharge port 20*a*.

Each of the discharge-end branch portions 20*b* extends radially outward from the corresponding cylinder bore 12*a*, as illustrated in FIG. 6. The discharge-end branch portions 20*b* radially extend, are further bent, and extend in one axial direction.

The discharge-end ring-shaped portion 20*c* is positioned so as to exteriorly surround the cylinder block 12, more specifically, the plurality of cylinder bores 12*a*. The discharge-end ring-shaped portion 20*c* is connected to the plurality of discharge-end branch portions 20*b*. Therefore, the working fluid is brought from the cylinder bores 12*a* to the discharge-end ring-shaped portion 20*c* via the discharge-end branch portions 20*b*. The discharge-end ring-shaped portion 20*c* is connected to the discharge port 20*a*. The working fluid brought to the discharge-end ring-shaped portion 20*c* is discharged from the discharge port 20*a*.

Figure 2:
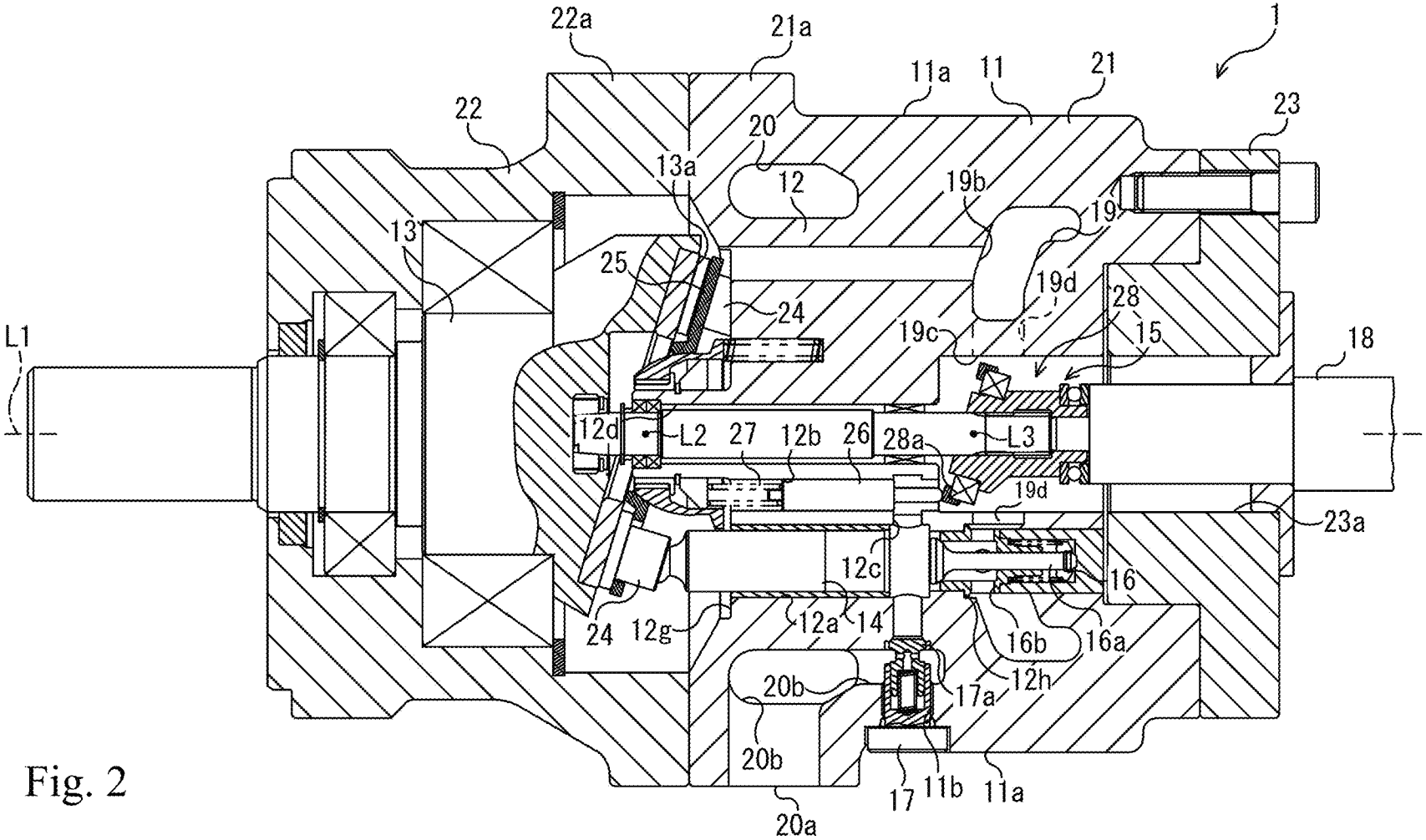
FIG. 2 is a cross-sectional view of the rotary swash plate hydraulic pump taken along the section line II-II indicated in FIG. 1.

The casing 11 includes a casing body 21, a first lid body 22, and a second lid body 23, as illustrated in FIG. 1 and FIG. 2. The casing 11 is formed by combining the casing body 21, the first lid body 22, and the second lid body 23. The casing body 21 houses the cylinder block 12 so as to prevent relative rotation thereof. The casing body 21 is a cylindrical member that extends along the predetermined axis L1. More specifically, the casing body 21 is in the shape of a prism including the nine flat surfaces 11*a* as side surfaces. In other words, the casing body 21 is in the shape of a nonagon as viewed from the other side in the axial direction. The inlet passage 19 is formed in the other end portion of the casing body 21. The discharge passage 20 is formed in an axially middle portion of the casing body 21. A flange 21*a* is formed on the outer peripheral surface of one end portion of the casing body 21 that is located on one side in the axial direction.

The first lid body 22 houses the rotary swash plate 13, which will be described in detail later. More specifically, the first lid body 22 houses the rotary swash plate 13 in an area on the other side in the axial direction. The first lid body 22 covers the casing body 21 so that the rotary swash plate 13 faces the cylinder block 12. The first lid body 22 is formed in the shape of a cylinder. The first lid body 22 covers an opening of the casing body 21 that is located on one side in the axial direction. Thus, the rotary swash plate 13 faces the cylinder block 12. A flange 22*a* is formed on the outer peripheral surface of the other end of the first lid body 22 which is on the other side in the axial direction. The first lid body 22 covers the casing body 21 so that the flange 22*a* is butted against the flange 21*a* of the casing body 21. The first lid body 22 is fixed to the casing body 21 by fastening the flanges 21*a*, 22*a* together.

The second lid body 23 is provided on the other axial end of the casing body 21 so as to block the inlet passage 19. The second lid body 23 is formed in the shape of a circular ring. The second lid body 23 is provided on the other axial end portion of the casing body 21. More specifically, the second lid body 23 fits into an opening of the casing body 21 that is located on the other side in the axial direction. A linear motion actuator 18 to be described later is attached to the second lid body 23 so as to block an inner hole 23*a*. Therefore, with the second lid body 23 provided on the other axial end portion of the casing body 21, the inlet passage 19 is blocked.

<Cylinder Block>

The cylinder block 12 includes the plurality of cylinder bores 12*a*, as illustrated in FIG. 5. Furthermore, the cylinder block 12 includes a plurality of spool holes 12*b*, a plurality of communication passages 12*c*, and a shaft insertion hole 12*d*, as illustrated in FIG. 1. The cylinder block 12 is disposed inside the casing 11 so as to prevent relative rotation thereof. More specifically, the cylinder block 12 is disposed inside the casing body 21 so as to prevent relative rotation thereof. The cylinder block 12 is fixed to the axially middle portion in the casing 11. In the present embodiment, the cylinder block 12 is integrally formed in the casing 11 (more specifically, the casing body 21). However, the cylinder block 12 may be separate from the casing 11. Note that in the case of being separate, the cylinder block 12 is fixed to the casing 11 by press fitting, spline connection, key connection, fastening, or joining, for example. The cylinder bores 12*a* are formed in one end surface 12*g* of the cylinder block 12. The other end surface 12*h* of the cylinder block 12 faces the inlet passage 19. The one end surface 12*g* is an end surface of the cylinder block 12 that is located on one side in the axial direction, and the other end surface 12*h* is an end surface of the cylinder block 12 that is located on the other side in the axial direction.

<Cylinder Bore>

Each of the cylinder bores 12*a* is connected to the inlet passage 19. In the present embodiment, the cylinder block 12 includes nine cylinder bores 12*a*. Note that the number of cylinder bores 12*a* is not limited to nine. The cylinder bores 12*a* are arranged circumferentially spaced apart (in the present embodiment, at equal distances) about the axis L1. The cylinder bores 12*a* extend from the one end surface 12*g* in the other axial direction. The cylinder bores 12*a* extend to the other end surface 12*h* through the cylinder block 12. As a result, the cylinder bores 12*a* are connected to the inlet passage 19 on the other side in the axial direction.

<Spool Hole>

Each of the spool holes 12*b* is formed in the cylinder block 12. More specifically, the same number of spool holes 12*b* as the cylinder bores 12*a* (in the present embodiment, nine spool holes 12*b*) are formed in the cylinder block 12. The spool holes 12*b* are connected to the inlet passage 19. More specifically, the spool holes 12*b* are connected to the tank 30 via the inlet passage 19. The spool holes 12*b* are also arranged circumferentially spaced apart (in the present embodiment, at equal distances) about the axis L1. More specifically, the spool holes 12*b* extend in the cylinder block 12 from the other end surface 12*h* in the one axial direction. The spool holes 12*b* are arranged on the other end surface 12*h* at equal distances around the shaft insertion hole 12*d*, which will be described in detail later. The spool holes 12*b* are positioned inward (in the present embodiment, radially inward) of the cylinder bores 12*a*.

<Communication Passage>

Each of the communication passages 12*c* connects one of the cylinder bores 12*a* and a corresponding one of the spool holes 12*b*, as illustrated in FIG. 1 and FIG. 2. This means that the same number of communication passages 12*c* as the cylinder bores 12*a* and the spool holes 12*b* (in the present embodiment, nine communication passages 12*c*) are formed in the cylinder block 12. The communication passages 12*c* are located on the side of the other end surface 12*h* in the cylinder block 12.

<Shaft Insertion Hole>

The shaft insertion hole 12*d* is formed along the axis L1 in the cylinder block 12. More specifically, the shaft insertion hole 12*d* extends from the one end surface 12*g* to the other end surface 12*h* through the cylinder block 12 in the axial direction.

<Rotary Swash Plate>

The rotary swash plate 13 includes a rotary swash plate-end inclined surface 13*a*, as illustrated in FIG. 1 and FIG. 2. The rotary swash plate 13 is housed in the casing 11 so as to be rotatable about the axis L1. More specifically, the rotary swash plate 13 is housed on one side in the axial direction in the casing 11. In the present embodiment, the rotary swash plate 13 is housed in the first lid body 22. The rotary swash plate 13 extends along the axis L1. The rotary swash plate 13 is supported on the casing 11 so as to be rotatable about the axis L1. The rotary swash plate 13 is disposed so as to face the one end surface 12*g* of the cylinder block 12. One end portion of the rotary swash plate 13 protrudes from one end of the casing 11. In an area located on one side in the axial direction, the one end portion of the rotary swash plate 13 is coupled to the drive source mentioned above. The rotary swash plate 13 is rotatably driven by the drive source. The rotary swash plate 13 rotates to reciprocate the pistons 14, which will be described in detail later. In the present embodiment, the rotary swash plate 13 integrally includes: a disc-shaped portion including the rotary swash plate-end inclined surface 13*a*; and a shaft portion that is rotatably supported, but the disc-shaped portion and the shaft portion may be separately formed.

The rotary swash plate-end inclined surface 13*a* is formed on the other end of the rotary swash plate 13. The rotary swash plate-end inclined surface 13*a* faces the one end surface 12*g* of the cylinder block 12. The rotary swash plate-end inclined surface 13*a* is tilted toward the one end surface 12*g* of the cylinder block 12 about a first perpendicular axis L2. The first perpendicular axis L2 is an axis perpendicular to the axis L1. In the present embodiment, the tilt angle of the rotary swash plate-end inclined surface 13*a* is fixed. Note that for the sake of explanation, the slope of the rotary swash plate-end inclined surface 13*a* illustrated in FIG. 2 is different from the slope of the rotary swash plate-end inclined surface 13*a* illustrated in FIG. 1.

<Piston>

The plurality of pistons 14 are inserted into the corresponding cylinder bores 12*a* of the cylinder block 12. In other words, the same number of pistons 14 as the cylinder bores 12*a* (in the present embodiment, nine pistons 14) are inserted into the cylinder block 12. When the rotary swash plate 13 rotates, each of the pistons 14 reciprocates within the corresponding cylinder bore 12*a*. More specifically, the pistons 14 are in abutment with the rotary swash plate-end inclined surface 13*a*. The rotary swash plate-end inclined surface 13*a* slides on the pistons 14. When the rotary swash plate 13 rotates, each of the pistons 14 reciprocates within the corresponding cylinder bore 12*a* with a stroke length corresponding to the tilt angle. Note that the pistons 14 are in abutment with the rotary swash plate-end inclined surface 13*a* of the rotary swash plate 13 via shoes 24 in the present embodiment. Each of the shoes 24 is pressed against the rotary swash plate-end inclined surface 13*a* by a pressing plate 25. Thus, when the rotary swash plate 13 rotates, the pistons 14 reciprocate in one axial direction and the other axial direction via the shoes 24.

<Variable Capacity Mechanism>

The variable capacity mechanism 15 includes a plurality of spools 26, a plurality of springs 27, and a swash plate rotating shaft 28, as illustrated in FIG. 1 and FIG. 2. In the present embodiment, the variable capacity mechanism 15 includes the same number of spools 26 and springs 27 as the spool holes 12*b*, specifically, nine spools 26 and nine springs 27. The variable capacity mechanism 15 adjusts the effective stroke length S of each of the pistons 14. In the present embodiment, the variable capacity mechanism 15 changes the effective stroke lengths S of the pistons 14 by adjusting the opening and closing of the cylinder bores 12*b*. By changing the effective stroke lengths S of the pistons 14, the variable capacity mechanism 15 changes the discharge capacity of the pump 1.

More specifically, the variable capacity mechanism 15 adjusts the opening and closing of the cylinder bore 12*a* during the travel of the piston 14 from the bottom dead center to the top dead center (in other words, in the discharge process). Note that the aforementioned top dead center is the position of the piston 14 that is at the far end on the other side in the axial direction, and the aforementioned bottom dead center is the position of the piston 14 that is at the far end on one side in the axial direction. By adjusting the opening and closing of the cylinder bores 12*a*, the variable capacity mechanism 15 adjusts the effective stroke lengths S of the pistons 14. However, the variable capacity mechanism 15 is not limited to a mechanism that adjusts the effective stroke length S of every piston 14. The variable capacity mechanism 15 is positioned radially inward of the nine cylinder bores 12*a* in the cylinder block 12.

<Spool>

The spools 26 are arranged corresponding to the cylinder bores 12*a*, respectively. Each of the spools 26 is inserted into a corresponding one of the spool holes 12*b* of the cylinder block 12 in such a manner that the spool 26 can reciprocate therein. Therefore, the spools 26 are positioned radially inward of the cylinder bores 12*a*. The spool 26 opens and closes the corresponding cylinder bore 12*a*. More specifically, the spool 26 reciprocates to open and close the path between the corresponding cylinder bore 12*a* and the tank 30. In the present embodiment, the spool 26 opens to connect the corresponding cylinder bore 12*a* and the inlet passage 19. Thus, the cylinder bores 12*a* are connected to the tank 30 via the inlet passage 19. The spools 26 adjust the effective stroke lengths S of the pistons 14 by adjusting the opening and closing of the paths between the cylinder bores 12*a* and the tank 30 in the discharge process.

<Spring>

Each of the springs 27 is compressed when inserted into a corresponding one of the spool holes 12*b*. More specifically, the spring 27 is disposed on one side of the spool 26 in the axial direction in the spool hole 12*b*. The springs 27 bias the spools 26 toward the swash plate rotating shaft 28 to be described later.

<Swash Plate Rotating Shaft>

The swash plate rotating shaft 28 includes a swash plate rotating shaft-end inclined surface 28*a*. The swash plate rotating shaft 28 rotates in conjunction with the rotary swash plate 13. The swash plate rotating shaft 28 rotates to reciprocate each of the spools 26. Thus, the swash plate rotating shaft 28 causes the spools 26 to open and close the paths between the cylinder bores 12*a* and the tank 30. More specifically, the swash plate rotating shaft 28 causes the spools 26 to reciprocate and thereby open and close the communication passages 12*c*. The swash plate rotating shaft 28 can change the opening/closing position of each of the spools 26. The opening/closing position of each of the spools 26 is a position at which the spool 26 starts opening the communication passage 12*c* and a position at which the spool 26 starts closing the communication passage 12*c*.

More specifically, the swash plate rotating shaft 28 is inserted through the shaft insertion hole 12*d* of the cylinder block 12 and extends along the axis L1. One axial end portion of the swash plate rotating shaft 28 protrudes from the shaft insertion hole 12*d* toward the rotary swash plate 13. The one axial end portion of the swash plate rotating shaft 28 is coupled to the rotary swash plate 13 so as to prevent relative rotation thereof. Therefore, the swash plate rotating shaft 28 rotates about the axis L1 in conjunction with the rotary swash plate 13. The other axial end portion of the swash plate rotating shaft 28 also protrudes from the shaft insertion hole 12*d* toward the inlet passage 19.

The swash plate rotating shaft-end inclined surface 28*a* is located on an axially middle portion of the swash plate rotating shaft 28. The swash plate rotating shaft-end inclined surface 28*a* faces the other end surface 12*h* of the cylinder block 12. More specifically, the swash plate rotating shaft-end inclined surface 28*a* faces the openings of the spool holes 12*b* that are located on the other side in the axial direction. The swash plate rotating shaft-end inclined surface 28*a* is tilted about a second perpendicular axis L3 parallel to the first perpendicular axis L2. The second perpendicular axis L3 is also an axis perpendicular to the axis L1. In the present embodiment, the swash plate rotating shaft-end inclined surface 28*a* is tilted in the same direction as the rotary swash plate-end inclined surface 13*a*. The tilt angle of the swash plate rotating shaft-end inclined surface 28*a* is fixed. The other axial ends of the spools 26 that are biased by the springs 27 are in abutment with the swash plate rotating shaft-end inclined surface 28*a*. The swash plate rotating shaft-end inclined surface 28*a* slidably rotates on the spools 26. Therefore, when the swash plate rotating shaft 28 rotates, the spools 26 reciprocate within the spool holes 12*b* with a stroke length corresponding to the tilt angle of the swash plate rotating shaft-end inclined surface 28*a*.

The swash plate rotating shaft-end inclined surface 28*a* can move back and forth in the axial direction. By moving back and forth, the swash plate rotating shaft-end inclined surface 28*a* adjusts the opening and closing of the path between the cylinder bore 12*a* and the tank 30. More specifically, the swash plate rotating shaft-end inclined surface 28*a* moves back and forth to adjust the opening/closing position of the spool 26. The linear motion actuator 18 is connected to the other axial end portion of the swash plate rotating shaft 28. Note that the linear motion actuator 18 may either be an electric linear motion actuator or a hydraulic linear motion actuator. The linear motion actuator 18 is attached to the second lid body 23 as mentioned earlier. More specifically, the linear motion actuator 18 is attached to the second lid body 23 from the outside of the casing 11 so as to block the inner hole 23*a* of the second lid body 23. The linear motion actuator 18 causes the swash plate rotating shaft-end inclined surface 28*a* to move back and forth so as to move toward and away from the other end surface 12*h* of the cylinder block 12. Thus, the opening and closing of the paths between the cylinder bores 12*a* is adjusted. More specifically, it is possible to change the dead center position (more specifically, the axial position of the dead center) of the spool 26 in the cylinder bore 12*a*. For example, when the swash plate rotating shaft-end inclined surface 28*a* moves forward in the one axial direction, the dead center position of the spool 26 in the cylinder bore 12*a* shifts in the one axial direction. On the other hand, when the swash plate rotating shaft-end inclined surface 28*a* moves backward in the other axial direction, the dead center position of the spool 26 in the cylinder bore 12*a* shifts in the other axial direction. Therefore, the opening/closing position of the spool 26 in the cylinder bore 12*a* can be shifted in the axial direction.

The effective stroke length S of the piston 14 is a range of stroke in which the working fluid can be discharged from the cylinder bore 12*a*. Therefore, by shifting the opening/closing position of the spool 26 in the axial direction, it is possible to change the effective stroke length S of the piston 14. Thus, it is possible to change the discharge capacity of the cylinder bore 12*a* by moving the swash plate rotating shaft-end inclined surface 28*a* back and forth in the axial direction.

<Inlet Check Valve>

Each of the inlet check valves 16 allows the flow of the working fluid in one direction from the inlet passage 19 to the corresponding cylinder bore 12*a* and blocks the opposite flow of the working fluid. The inlet check valves 16 are provided on the cylinder bores 12*a*. In the present embodiment, there are the same number of inlet check valves 16 as the cylinder bores 12*a*, specifically, nine inlet check valves 16. The inlet check valves 16 are inserted into the cylinder bores 12*b* on one side in the axial direction, as illustrated in FIG. 5. The other end portion of the inlet check valve 16 protrudes from the cylinder bore 12*a* to the inlet passage 19 (more specifically, the inlet-end ring-shaped portion 19*b*). The inlet check valves 16 open and close the cylinder bores 12*a*, as illustrated in FIG. 1. More specifically, the inlet check valve 16 includes a check valve body 16*a* and an inner passage 16*b*. The inner passage 16*b* connects the inlet-end ring-shaped portion 19*b* and the cylinder bore 12*a*. By opening and closing the inner passage 16*b*, the check valve body 16*a* opens and closes the path between the inlet-end ring-shaped portion 19*b* and the cylinder bore 12*a*. This allows the flow of the working fluid in one direction from the inlet passage 19 to the cylinder bore 12*a* and blocks the opposite flow of the working fluid. More specifically, each of the plurality of inlet check valves 16 allows the flow of the working fluid from the inlet passage 19 to the cylinder bore 12*a* in the intake process in which the piston 14 moves from the top dead center to the bottom dead center. On the other hand, in the discharge process, the inlet check valve 16 stops the flow of the working fluid from the inlet passage 19 to the cylinder bore 12*a*. The inner passage 16*b* is open to the communication portion 19*d*. Therefore, the inlet-end ring-shaped portion 19*b* is always connected to the spool holes 12*b*.

<Discharge Check Valve>

Each of the plurality of discharge check valves 17 illustrated in FIG. 1 allows the flow of the working fluid in one direction from the corresponding cylinder bore 12*a* to the discharge port 20*a* and blocks the opposite flow of the working fluid. Each of the discharge check valves 17 is provided on a corresponding one of the cylinder bores 12*a*, as illustrated in FIG. 6. Therefore, there are the same number of discharge check valves 17 as the discharge-end branch portions 20*b*, specifically, nine discharge check valves 17, in the present embodiment. Each of the discharge check valves 17 is provided on a corresponding one of the discharge-end branch portions 20*b* of the discharge passage 20. More specifically, the discharge check valve 17 is inserted from the outer peripheral surface of the casing 11 into a radially extending portion of the discharge-end branch portion 20*b*.

More specifically, an insertion hole 11*b* is formed in each of the flat surfaces 11*a* of the outer peripheral surface of the casing 11. The insertion hole 11*b* extends toward the radially extending portion of the discharge-end branch portion 20*b*. In the present embodiment, the insertion hole 11*b* is formed on the same axis as the radially extending portion of the discharge-end branch portion 20*b*. Each of the discharge check valves 17 is inserted into the radially extending portion of the corresponding discharge-end branch portion 20*b* via the corresponding insertion hole 11*b*.

The discharge check valves 17 open and close the discharge passage 20. More specifically, the discharge check valves 17 open and close the discharge-end branch portions 20*b* (more specifically, the radially extending portions thereof) by the check valve bodies 17*a*. The check valve bodies 17*a* open the discharge passage 20 in the discharge process. Therefore, the discharge check valves 17 allow the flow of the working fluid in one direction from the cylinder bores 12*a* to the discharge-end ring-shaped portion 20*c* (or the discharge port 20*a*) in the discharge process. On the other hand, the nine discharge check valves 17 block the opposite flow of the working fluid. Therefore, in the intake process, the flow of the working fluid from the cylinder bores 12*a* to the discharge port 20*a* is stopped.

<Operation of Pump>

Next, the operation of the pump 1 will be described. When the drive source rotatably drives the rotary swash plate 13, each of the pistons 14 reciprocates within the corresponding cylinder bore 12*a* accordingly. Thus, the piston 14 draws the working fluid from the inlet passage 19 into the cylinder bore 12*a* via the inlet check valve 16 in the intake process.

On the other hand, the piston 14 discharges the working fluid from the cylinder bore 12*a* via the discharge check valve 17 and the discharge passage 20 in the discharge process. More specifically, when the working fluid in the cylinder bore 12*a* is pressurized by the piston 14 in the discharge process, the discharge check valve 17 eventually opens the discharge passage 20. Therefore, the working fluid is brought from the cylinder bore 12*a* to the discharge-end ring-shaped portion 20*c* via the discharge-end branch portion 20*b*. Furthermore, the working fluid is discharged from the discharge port 20*a*.

Furthermore, in the pump 1, when the swash plate rotating shaft 28 rotates in conjunction with the rotation of the rotary swash plate 13, each of the spools 26 reciprocates within the corresponding spool hole 12*b* in synchronization with the corresponding piston 14. As a result, the communication passage 12*c* is opened midway through the intake process of the piston 14, and the communication passage 12*c* is closed midway through the discharge process of the piston 14. Thus, the cylinder bore 12*a* and the communication passage 12*c* are in communication until the communication passage 12*c* is closed (in other words, until the piston 14 travels the open stroke length S2) in the discharge process. The discharge of the working fluid from the cylinder bore 12*a* to the discharge port 20*a* is limited until the communication passage 12*c* is closed. Therefore, the effective stroke length S of each of the pistons 14 is less than the actual stroke length S1 by the open stroke length S2, and the pump 1 discharges an amount of the working fluid that corresponds to the effective stroke length S. In the pump 1, the linear motion actuator 18 moves the swash plate rotating shaft-end inclined surface 28*a* in the axial direction, and thus the opening/closing position of each of the spools 26 is changed. As a result, the effective stroke length S of each of the pistons 14 can be changed, meaning that the discharge capacity of the pump 1 is increased or decreased.

In the pump 1 according to the present embodiment, the inlet passage 19 includes the plurality of inlet ports 19*a*. Therefore, regarding paths in which the working fluid flows from the inlet ports 19*a* to the cylinder bores 12*a*, the differences between the cylinder bores 12*a* can be reduced. Thus, the variations among the cylinder bores 12*a* regarding pressure loss that occurs in the working fluid can be reduced. As a result, in the plurality of cylinder bores 12*a*, inlet pressure for drawing in the working fluid can be secured.

Furthermore, in the pump 1 according to the present embodiment, the inlet-end ring-shaped portion 19*b* is formed in the shape of a ring. Therefore, regarding paths in which the working fluid flows from the inlet ports 19*a* to the cylinder bores 12*a*, the differences between the cylinder bores 12*a* can be reduced. Thus, the variations among the cylinder bores 12*a* regarding pressure loss that occurs in the working fluid can be further reduced.

Furthermore, in the pump 1 according to the present embodiment, the plurality of inlet ports 19*a* and the discharge port 20*a* are formed in the outer peripheral surface of the casing 11 in phases that are different in the circumferential direction, as viewed in the axial direction. This results in a reduction in the mutual interference between pipes (not illustrated in the drawings) that are connected to the ports 19*a*, 20*a*. Therefore, it is possible to improve the flexibility of piping layout.

Furthermore, in the pump 1 according to the present embodiment, the plurality of inlet ports 19*a* and the discharge port 20*a* are formed in the outer peripheral surface of the casing 11 and therefore, a wide area can be used for the cylinder bores 12*a* as compared to the case where those are formed in an end surface of the casing 11. Therefore, the variable capacity mechanism 15 can be positioned inward of the plurality of cylinder bores 12*a* in the cylinder block 12. This keeps the pump 1 from increasing in size.

Furthermore, in the pump 1 according to the present embodiment, each of the plurality of discharge check valves 17 is inserted from the outer peripheral surface of the casing 11 toward the corresponding cylinder bore 12*a*. Therefore, each of the discharge check valves 17 is easily mounted.

Furthermore, in the pump 1 according to the present embodiment, each of the plurality of discharge check valves 17 is inserted from a corresponding one of the plurality of flat surfaces 11*a* of the casing 11 toward the corresponding cylinder bore 12*a*. Therefore, the insertion hole 11*b* through which the discharge check valve 17 is inserted can be easily formed in the casing 11.

Furthermore, in the pump 1 according to the present embodiment, the first lid body 22 covers the casing body 21 so that the rotary swash plate 13 faces the cylinder block 12. Therefore, the rotary swash plate 13 and the cylinder block 12 can be housed in separate parts upon assembly, meaning that the rotary swash plate 13 and the cylinder block 12 can be easily housed in the casing.

Furthermore, in the pump 1 according to the present embodiment, the inlet passage 19 is formed at the other axial end of the casing body 21, and the second lid body 23 is provided at the other axial end of the casing body 21 so as to block the inlet passage 19. Therefore, the inlet passage 19 can be easily formed.

Other Embodiments

The pump 1 according to the present embodiment may be a hydraulic pump of the fixed capacity type. In other words, the pump 1 does not necessarily need to include the variable capacity mechanism 15. The variable capacity mechanism 15 is not limited to having the configuration described above; it is sufficient that the variable capacity mechanism 15 be a mechanism that changes the effective stroke length S of each of the pistons 14 by adjusting the opening and closing of the corresponding cylinder bore 12*a*. The two inlet ports 19*a* do not necessarily need to be 180 degrees apart in the circumferential direction. The discharge port 20*a* does not need to be 90 degrees apart from the two inlet ports 19*a* in the circumferential direction and may be formed in a phase that is the same as a phase in which one of the two inlet ports 19*a* is located. Furthermore, the two ports 19*a*, 20*a* do not necessarily need to be formed in the outer peripheral surface of the casing 11 and may be formed in one axial end surface or the other axial end surface of the casing 11.

In the pump 1 according to the present embodiment, the plurality of discharge check valves 17 are inserted from the outer peripheral surface of the casing 11 toward the cylinder bores 12*a*, but may be inserted from the first lid body 22 or the second lid body 23. The casing 11 is not limited to being in the shape of a prism and may be in the shape of a circular column. In other words, the external shape of the casing 11 may be circular instead of being polygonal. In this case, counterbores corresponding to the number of cylinder bores 12*a* are formed in the outer peripheral surface of the casing 11. The insertion holes 11*b* are formed from the counterbores toward the cylinder bores 12*a* (in the present embodiment, the radially extending portions).

In the pump 1 according to the present embodiment, the casing 11 does not necessarily need to be configured to be divisible as the casing body 21, the first lid body 22, and the second lid body 23, and may be configured to be divisible into more members. The first lid body 22 does not necessarily need to house the rotary swash plate 13; the rotary swash plate 13 may be housed in the casing body 21.

From the foregoing description, many modifications and other embodiments of the present invention would be obvious to a person having ordinary skill in the art. Therefore, the foregoing description should be interpreted only as an example and is provided for the purpose of teaching the best mode for carrying out the present invention to a person having ordinary skill in the art. Substantial changes in details of the structures and/or functions of the present invention are possible within the spirit of the present invention.

REFERENCE CHARACTER LIST

1 rotary swash plate hydraulic pump
11 casing
11*a* flat surface
12 cylinder block
12*a* cylinder bore
13 rotary swash plate
14 piston
15 variable capacity mechanism
17 discharge check valve
19 inlet passage
19*a* inlet port
20 discharge passage
20*a* discharge port
21 casing body
22 first lid body
23 second lid body
L1 axis

The invention claimed is:

1. A rotary swash plate hydraulic pump comprising:

a casing including an inlet passage;

a cylinder block disposed in the casing so as to prevent relative rotation of the cylinder block and including a plurality of cylinder bores connected to the inlet passage;

a plurality of pistons each of which is inserted into a corresponding one of the plurality of cylinder bores;

a rotary swash plate that is housed in the casing so as to be rotatable about an axis and reciprocates each of the plurality of pistons; and a variable capacity mechanism that changes an effective stroke length of each of the plurality of pistons by adjusting opening and closing of the corresponding one of the plurality of cylinder bores, wherein the inlet passage includes a plurality of inlet ports through which a working fluid is drawn, a discharge passage including a discharge port through which the working fluid is discharged is formed in an outer peripheral surface of the casing, the plurality of cylinder bores are arranged about the axis in the cylinder block, and the variable capacity mechanism is positioned inward of the plurality of cylinder bores in the cylinder block.

2. The rotary swash plate hydraulic pump according to claim 1, wherein the inlet passage includes an inlet-end ring-shaped portion connected to each of the plurality of inlet ports and the plurality of cylinder bores, and the inlet-end ring-shaped portion is formed in the shape of a ring.

3. The rotary swash plate hydraulic pump according to claim 1, wherein the discharge port is formed in the outer peripheral surface of the casing in a phase different in a circumferential direction from a phase in which the plurality of inlet ports are located.

4. The rotary swash plate hydraulic pump according to claim 3, further comprising:

a plurality of discharge check valves each of which is provided on the corresponding one of the plurality of cylinder bores and opens and closes the discharge passage, wherein each of the plurality of discharge check valves is inserted toward the corresponding one of the plurality of cylinder bores on the outer peripheral surface of the casing.

5. The rotary swash plate hydraulic pump according to claim 4, wherein the casing is in the shape of a prism including a plurality of flat surfaces as a side surface, and each of the plurality of discharge check valves is inserted toward the corresponding one of the plurality of cylinder bores on a corresponding one of the plurality of flat surfaces.

6. The rotary swash plate hydraulic pump according to claim 1, wherein the casing includes: a casing body that houses the cylinder block so as to prevent relative rotation of the cylinder block; and a first lid body that houses the rotary swash plate, and the first lid body covers the casing body so that the rotary swash plate faces the cylinder block.

7. The rotary swash plate hydraulic pump according to claim 6, wherein the casing further includes a second lid body, the inlet passage is formed at an opposite axial end of the casing body, and the second lid body is provided at the axial end of the casing body so as to block the inlet passage.

* * * * *